US005833397A

United States Patent [19]

Horton, III

[11] Patent Number: 5,833,397

[45] Date of Patent: Nov. 10, 1998

[54] SHALLOW DRAFT FLOATING OFFSHORE DRILLING/PRODUCING STRUCTURE

[75] Inventor: Edward E. Horton, III, Houston, Tex.

[73] Assignee: Deep Oil Technology, Incorporated, Houston, Tex.

[21] Appl. No.: 721,814

[22] Filed: Sep. 27, 1996

[51] Int. Cl.[6] ..... B63B 35/44; E02B 17/00

[52] U.S. Cl. ..... 405/204; 114/264; 405/28; 405/224

[58] Field of Search ..... 405/224, 223.1, 405/208, 209, 204, 203; 114/264, 265

[56] References Cited

U.S. PATENT DOCUMENTS

| | | | |
|---|---|---|---|
| 4,470,721 | 9/1984 | Shotbolt | 405/223.1 X |
| 4,938,632 | 7/1990 | Eie | 405/224 |
| 4,973,200 | 11/1990 | Kaldenbach | 405/209 X |
| 5,542,783 | 8/1996 | Pollack | 405/223.1 |
| 5,575,592 | 11/1996 | Pollack | 405/224 X |

*Primary Examiner*—Dennis L. Taylor
*Attorney, Agent, or Firm*—Robert J. Edwards; D. Neil LaHaye

[57] ABSTRACT

A shallow draft floating offshore drilling/producing structure. The structure is formed from a buoyant hull on which one or more modules or decks may be placed to support process equipment, a drilling rig, utilities, and accommodations for personnel. Drilling and/or producing is accomplished through a center well in the hull. The hull includes fixed ballast, an oil storage area, and voids and variable ballast for offsetting the lighter weight of the stored oil. The hull is designed to have a relatively small water plane area. The hull is also designed to have roll and pitch periods that are detuned from waves in the area that the hull is to be installed.

3 Claims, 4 Drawing Sheets

SHALLOW DRAFT FLOATING OFFSHORE DRILLING/PRODUCING STRUCTURE

BACKGROUND OF THE INVENTION

1. Field of the Invention

The invention is generally related to drilling and producing oil offshore and more particularly to floating structures used in such operations.

2. General Background

In the offshore oil industry, floating structures are used in areas where deep water results in the cost of a jacket fixed to the sea floor too expensive to realize a sufficient economic return, even for large oil reserves. Such floating structures have been semi-submersible jack-up rigs, a vessel that is moored in place by the use of multiple anchors, dynamically positioned vessels that use a number of thrusters to hold the barge in position at the site, and tension leg platforms (TLP's).

Each structure has advantages and disadvantages. For example, while dynamically positioned vessels eliminate the need for anchors and mooring lines, they present a large surface area to waves and currents, which can result in a substantial amount of power required to hold the vessel in position. The large surface area also results in the vessel being subject to heave, pitch, and roll motions in response to wave action. The semi-submersible jack-up rigs present less surface area to waves and so are less susceptible to pitch and roll motions but are still subject to heave motions and are not designed to store large quantities of oil.

Minimizing environmentally induced motions is desirable not only from a safety and comfort standpoint, but also from an operational standpoint since drilling and producing connections must be designed to accommodate the motions of the structure. The cost of designing and building connections is directly related to the amount of heave, pitch, and roll of the structure.

The TLP is relatively successful at minimizing heave, pitch, and roll. However, the TLP is a deep draft structure that is designed primarily for deep water where the seas may become relatively rough.

The present state of the art does not adequately address deep water areas of the world where the waters are relatively benign and the maximum waves seldom if ever exceed thirty or forty feet.

SUMMARY OF THE INVENTION

The invention addresses such areas. What is provided is a shallow draft floating structure that combines the benefits of the different types of floating structures presently in use. The structure is formed from a buoyant hull on which one or more modules or decks may be placed to support process equipment, a drilling rig, utilities, and accommodations for personnel. Drilling and/or producing is accomplished through a center well in the hull. The hull includes fixed ballast, an oil storage area, and voids and variable ballast for offsetting the lighter weight of the stored oil. The hull is designed to have a relatively small water plane area. The hull is also designed to have roll and pitch periods that are detuned from waves in the area that the hull is to be installed.

It is an object of the invention to provide a floating offshore structure that allows the hull and decks to be constructed independently of each other and assembled at a site that is not necessarily the final field location, which will reduce the schedule and cost of the project.

It is another object of the invention to provide a floating offshore structure that has very favorable heave, pitch, and roll motion characteristics, which will allow the use of steel production and drilling risers and allow drilling operations that are less affected by changing weather conditions.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
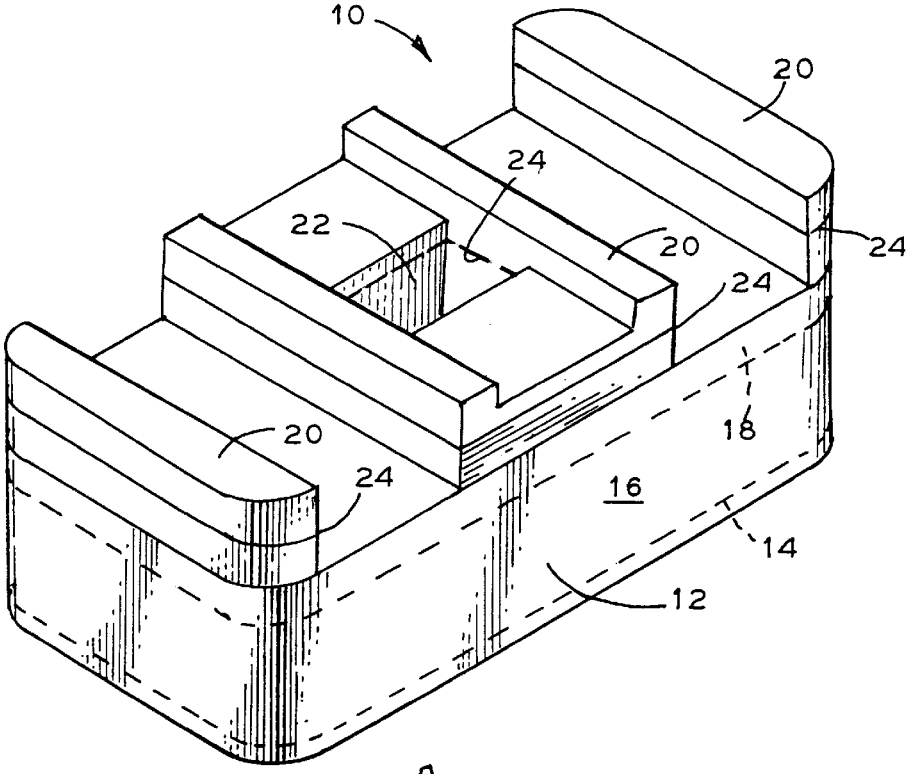
FIG. 1 is an isometric view of the invention.

Referring to the drawings, it is seen in FIG. 1 that the invention is generally indicated by the numeral 10. Shallow draft floating structure 10 is comprised of a buoyant hull 12 that includes a section 14 for fixed ballast, a section 16 for oil storage, a section 18 for voids and variable ballast, and a section 20 to receive and support modules or decks for process equipment, a drilling rig, utilities, and accommodations for personnel. The hull 12 is also provided with a well 22 that extends vertically through the hull to accommodate risers used during drilling of and production from subsea wells.

In the preferred embodiment, fixed ballast section 14 is at the lower end of the hull 12. Placing the fixed ballast at the lower end of the structure positions the center of gravity below the center of buoyancy. The fixed ballast may be formed from any suitable material such as concrete to help reduce the associated cost. Naturally, the thickness and weight of the fixed ballast will depend upon the size, weight, and displacement of the structure.

Figure 3:
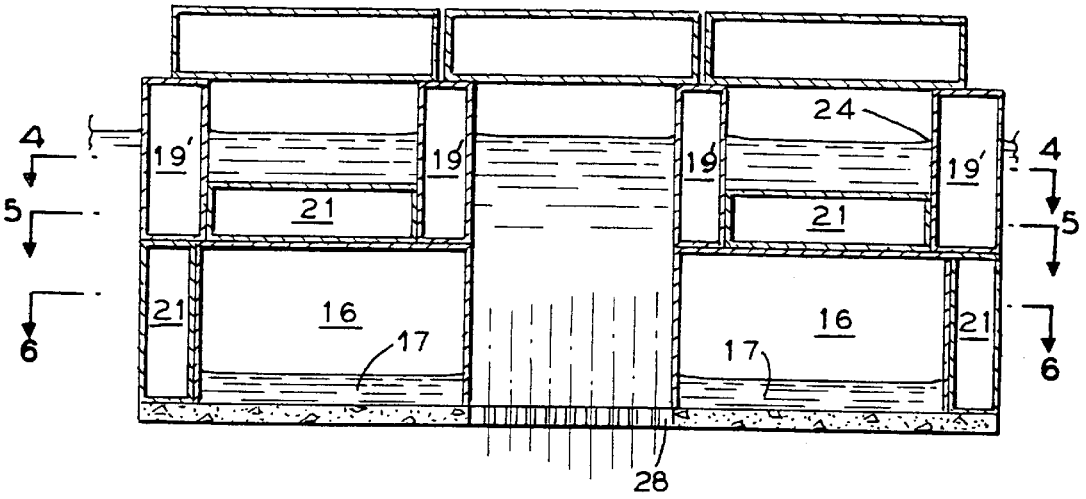
FIG. 3 is an inboard profile view of the invention with decks installed.

The oil storage section 16 is pressure equalized by allowing sea water to enter the storage section from the bottom. This is illustrated in FIG. 3 wherein numeral 17 indicates seawater in section 16 for pressure equalization to the sea. If necessary to meet certain oil tanker code requirements, oil storage section 16 may be formed using double walls.

Figure 6:
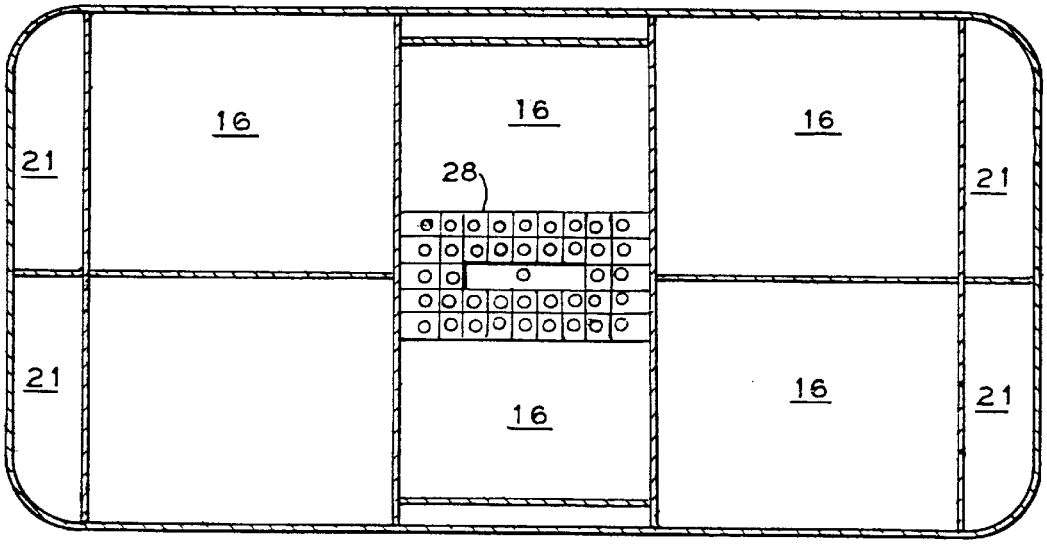
FIG. 6 is a view taken along lines 6—6 in FIG. 3.
Figure 8:
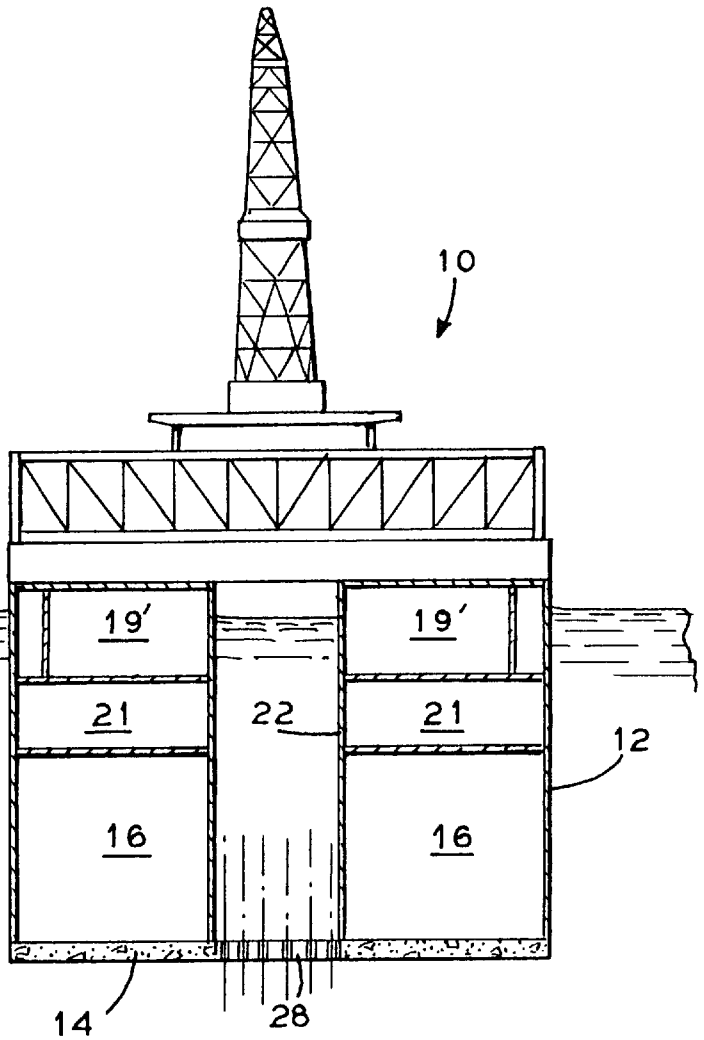
FIG. 8 is a view taken along lines 8—8 in FIG. 4.
Figure 7:
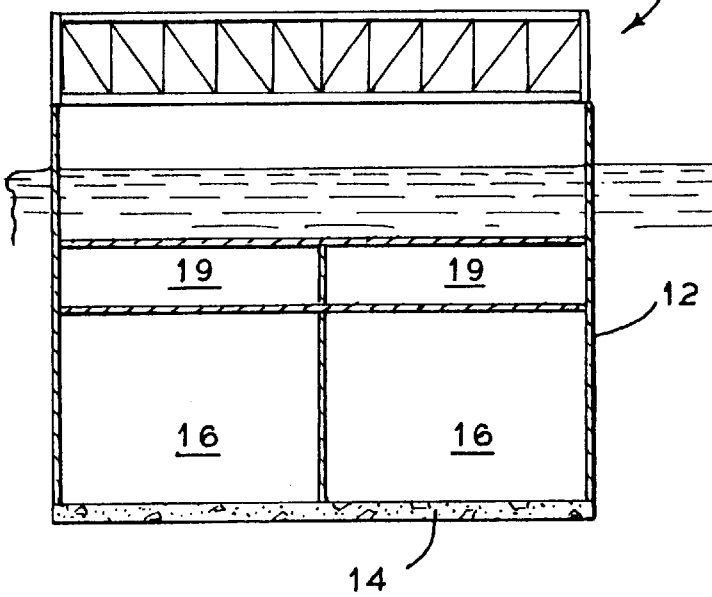
FIG. 7 is a view taken along lines 7—7 in FIG. 4.

The voids 19, seen in FIG. 7, provide buoyancy to the floating structure 10. The variable ballast portions 21 of section 18, seen in FIGS. 3, 6, and 8 are used to offset the lighter weight of the stored oil. In order to maintain a constant draft, approximately one cubic foot of sea water is needed to offset the buoyancy of one barrel of oil. Maintaining a constant draft is desirable since the risers are connected to the sea floor and the relative movement of the trees is limited.

Figure 2:
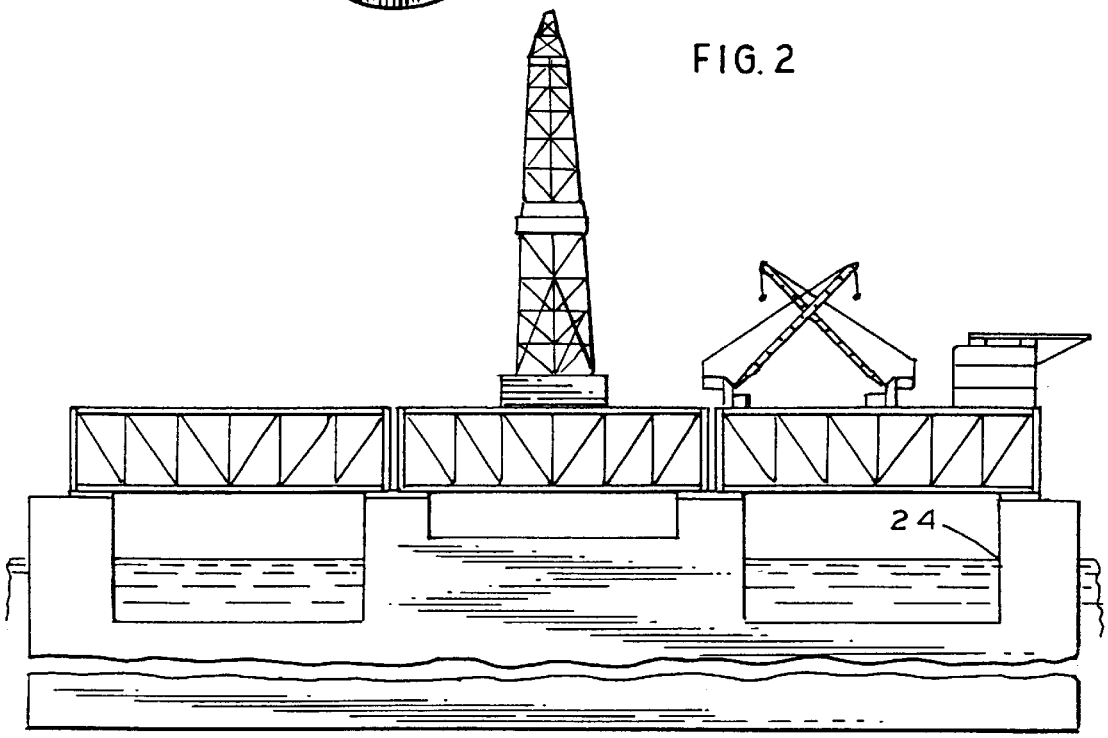
FIG. 2 is an outboard profile view of the invention with decks installed.

As best seen in FIGS. 1–3, the hull 12 is shaped and designed such that at its operating draft, as indicated at water line 24, the hull water plane area is relatively much smaller than the submerged lower area of the main portion of the hull. This is accomplished by having voids 19' at the center and each end of the hull, seen in FIGS. 3, 4, 5, and 8, extend upwardly from each end and the center section of the hull to define a substantially U-shaped or cut-out section at each end of the hull and in the center of the hull. When at the operating draft, the top of the U-shaped section is above the water plane and the bottom of the U-shaped section is underwater. This results in a much smaller water plane area than would be present if the operational draft of the hull were at the oil storage section 16, as is the case for ships. The relatively small water plane area provides a hull with a long natural period in heave that is well beyond the wave periods.

Figure 4:
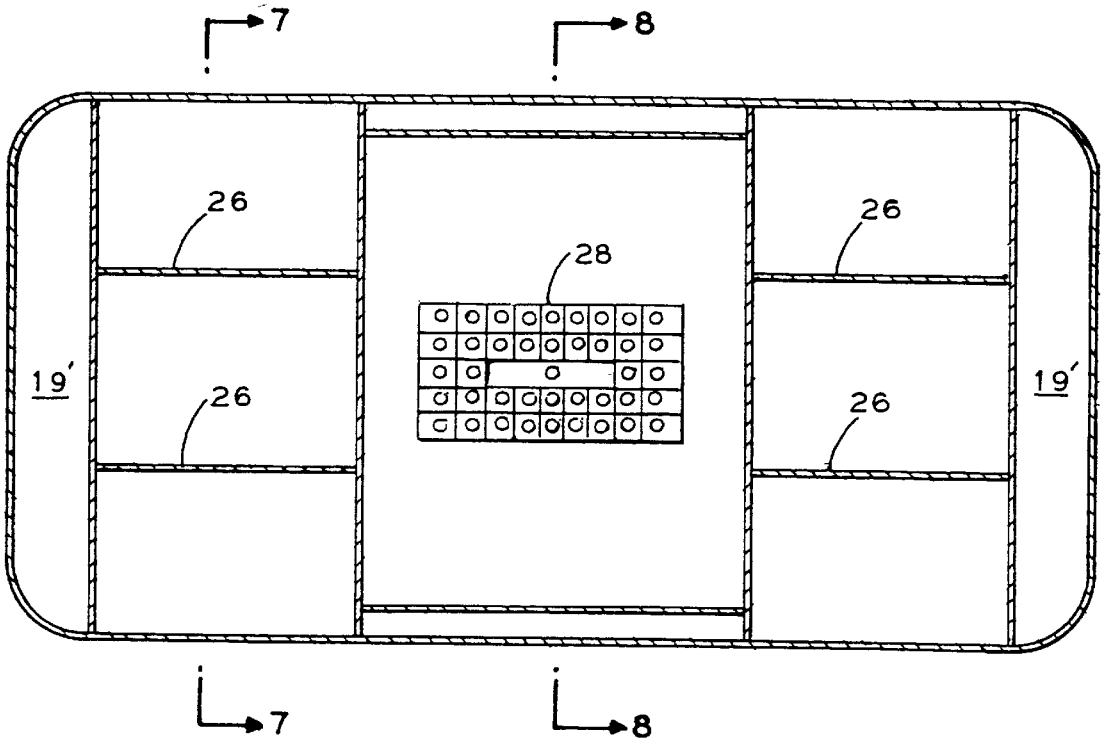
FIG. 4 is a view taken along lines 4—4 in FIG. 3.
Figure 5:
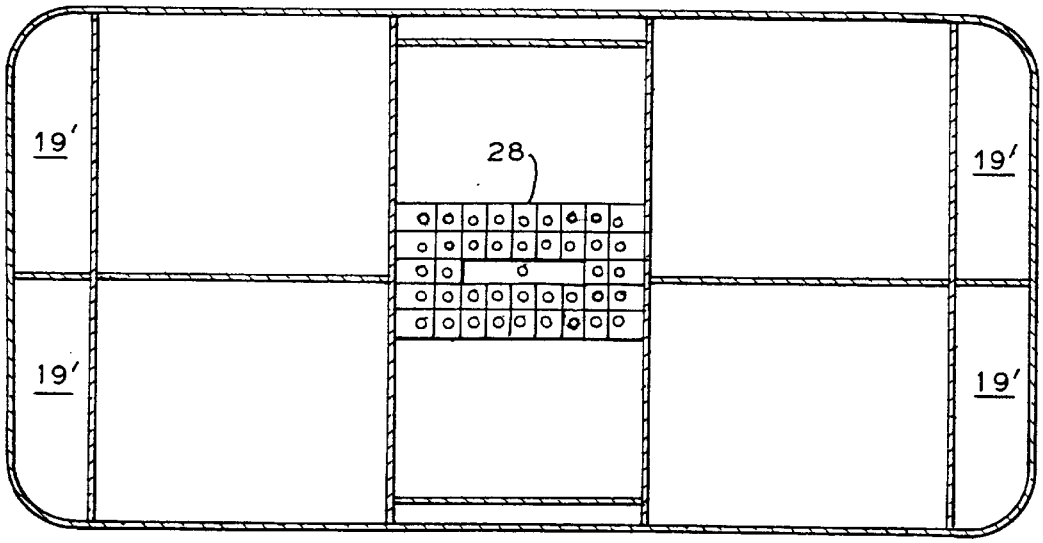
FIG. 5 is a view taken along lines 5—5 in FIG. 3.

The roll and pitch periods of the hull are detuned from the waves so that the structure has favorable roll and pitch motions. The motions of the structure may be further improved by providing baffles 26 in the cut outs or U-shaped sections at each end of the hull above the variable ballast sections 21. The baffles 26 illustrated in FIG. 4 are formed by vertical walls that extend between the end voids 19' and the center section of the hull. When at the operating draft, the baffles 26 act to mitigate the sloshing and free surface effect of sea water moving between the walls of the hull that support the decks. The center U-shaped section is designed to be above the operational draft water line to protect the risers in the center well 22 from wave action.

In operation, the variable ballast sections 21 of structure 10 may be used to vary the draft of the structure 10 during different phases of operation. For example, as a light ship, the draft may be adjusted to forty-five feet. For towing the structure to a site, the draft may be adjusted to a more stable draft of fifty to seventy feet. For drilling and/or producing operations, the draft may be adjusted to a draft of one hundred sixty feet as illustrated in FIGS. 1 and 2. It should be understood that the freeboard area of thirty feet indicated in FIGS. 1 and 2 is only an example and that forty-five feet may be more suitable in certain sea conditions.

The structure 10 is designed to be capable of being built at a different location from the support modules or decks for process equipment, drilling rig, utilities, and accommodations for personnel. This provides an advantage in the construction and installation sequence that can significantly reduce the schedule and cost of the project. Installation of the decks may be accomplished by ballasting the structure 10 down to a draft where barges on which the decks are supported can be floated into the cut outs of the hull and positioned over the support sections 20. The deck is then transferred to the hull by either ballasting down the barge, raising the hull by deballasting, or using a combination of both. Once the decks have been installed, the structure 10 may be towed to the operating site where it is then ballasted to the desired operating draft and moored in place.

Drilling and production risers to be used with the structure 10 may be chosen from several types known in the offshore industry.

Another feature that may be added is a flow restriction plate 28, seen in FIG. 3. The plate 28 serves to prevent the water level in the well 22 from resonating vertically if it has a similar period to the wave period. The plate is sized to allow the total opening for water flow to be approximate twenty to thirty percent of the cross sectional area of the well 22.

For a structure sized as indicated in the drawings, the following figures apply. The structure 10 can accommodate a deck structure weighing 10,000 tons with a deck load of 31,900 tons for a total topsides weight of 41,900 tons. The oil storage section 16 is capable of storing 1,500,000 barrels of oil. The steel weight of the hull 12 would be approximately 60,000 tons with a displacement of 514,000 tons and a fixed ballast of 72,100 tons. The well 22 is capable of having 40 slots for production and drilling. It should be understood that the dimensions illustrated and referred to in the drawings are to be taken as one example of the size that the invention may take and not as a limitation thereof.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A shallow draft floating offshore drilling/producing structure, comprising:

a. a buoyant hull having end portions that define at least one U-shaped section in said hull whereby the top of the U-shaped section is above the water plane and the bottom of the U-shaped section is underwater when said hull is positioned at the operating draft, said hull being adapted to receive a deck at the top of the U-shaped section;

b. a fixed ballast section at the lower end of said hull;

c. an oil storage section within said hull, said oil storage section being pressure equalized to the sea;

d. a variable ballast section within said hull; and e. said hull having a vertical well therethrough.

2. The offshore structure of claim 1, further comprising a baffle in the lower portion of the U-shaped section defined in said hull.

3. A shallow draft floating offshore drilling/producing structure, comprising:

a. a buoyant hull having end portions that define at least one U-shaped section in said hull whereby the top of the U-shaped section is above the water plane and the bottom of the U-shaped section is underwater when said hull is positioned at the operating draft, said hull being adapted to receive a deck at the top of the U-shaped section;

b. a fixed ballast section at the lower end of said hull;

c. an oil storage section within said hull, said oil storage section being pressure equalized to the sea;

d. a variable ballast section within said hull;

e. said hull having a vertical well therethrough; and f. a baffle in the lower portion of the U-shaped section defined in said hull.

* * * * *